US007507187B2

(12) United States Patent
Dyer et al.

(10) Patent No.: US 7,507,187 B2
(45) Date of Patent: Mar. 24, 2009

(54) PARAMETER SENSING SYSTEM FOR AN EXERCISE DEVICE

(75) Inventors: David E. Dyer, Renton, WA (US); Rodney P. West, Kirkland, WA (US); Victor Pipinich, Seattle, WA (US)

(73) Assignee: Precor Incorporated, Woodenville, WA (US)

( * ) Notice: Subject to any disclaimer, the term of this patent is extended or adjusted under 35 U.S.C. 154(b) by 679 days.

(21) Appl. No.: 10/818,719

(22) Filed: Apr. 6, 2004

(65) Prior Publication Data

US 2005/0227820 A1 Oct. 13, 2005

(51) Int. Cl.
*A63B 22/02* (2006.01)

(52) U.S. Cl. ..... 482/54; 482/8; 482/51; 119/700

(58) Field of Classification Search ..... 482/51, 482/54, 1–9, 57, 900–902; 335/306; 601/23; 434/247; 119/700
See application file for complete search history.

(56) References Cited

U.S. PATENT DOCUMENTS

| | | | | |
|---|---|---|---|---|
| 4,643,418 | A | 2/1987 | Bart | 272/69 |
| 4,708,337 | A | 11/1987 | Shyu | 272/69 |
| 4,720,789 | A | 1/1988 | Hector et al. | 364/410 |
| 4,828,257 | A | 5/1989 | Dyer et al. | 272/129 |
| 4,865,313 | A | 9/1989 | Kuo | 272/69 |
| 4,955,602 | A | 9/1990 | Rastelli | 272/76 |
| 4,974,831 | A | 12/1990 | Dunham | 272/69 |
| 4,998,725 | A | 3/1991 | Watterson et al. | 272/129 |
| 5,007,630 | A | 4/1991 | Real et al. | 272/69 |
| 5,062,626 | A | 11/1991 | Dalebout et al. | 272/69 |
| 5,062,632 | A | 11/1991 | Dalebout et al. | 272/129 |
| 5,067,710 | A | 11/1991 | Watterson et al. | 272/129 |
| 5,104,120 | A | 4/1992 | Watterson et al. | 482/5 |
| 5,149,084 | A | 9/1992 | Dalebout et al. | 482/3 |
| 5,213,555 | A | 5/1993 | Hood et al. | 482/57 |
| 5,314,391 | A | 5/1994 | Potash et al. | 482/54 |
| 5,368,532 | A | 11/1994 | Farnet | 482/5 |
| 5,383,826 | A | 1/1995 | Michael | 482/3 |
| 5,466,200 | A | 11/1995 | Ulrich et al. | 482/4 |
| 5,476,430 | A | 12/1995 | Lee et al. | 482/54 |
| 5,489,249 | A | 2/1996 | Brewer et al. | 482/5 |
| 5,512,025 | A | 4/1996 | Dalebout et al. | 482/6 |
| 5,554,033 | A | 9/1996 | Bizzi et al. | 434/247 |
| 5,645,509 | A | 7/1997 | Brewer et al. | 482/4 |
| 5,655,997 | A | 8/1997 | Greensberg et al. | 482/5 |
| 5,706,822 | A | 1/1998 | Khavari | 128/668 |

(Continued)

FOREIGN PATENT DOCUMENTS

| | | |
|---|---|---|
| EP | 0 403 924 | 12/1990 |

(Continued)

*Primary Examiner*—Glenn Richman
(74) *Attorney, Agent, or Firm*—Terence P. O'Brien; Todd A. Rathe

(57) ABSTRACT

A treadmill includes a frame, a deck assembly, at least one deck deflection sensor, and a control system. The deck assembly is supported by the frame. The deck assembly includes a longitudinally extending deck, at least first and second rollers, and a belt positioned about the deck and the first and second rollers. The deck deflection sensor is coupled to the deck. The deck deflection sensor is a contactless displacement sensor including an electrical intermediate device and an aerial. The control system is operably coupled to the at least one deck deflection sensor.

76 Claims, 6 Drawing Sheets

U.S. PATENT DOCUMENTS

| | | | | |
|---|---|---|---|---|
| 5,777,895 | A | 7/1998 | Kuroda et al. | 364/550 |
| 5,785,632 | A | 7/1998 | Greenberg et al. | 482/5 |
| 5,800,314 | A | 9/1998 | Sakakibara et al. | 482/54 |
| 5,820,525 | A | 10/1998 | Riley | 482/54 |
| 5,830,162 | A * | 11/1998 | Giovannetti | 601/23 |
| 5,888,172 | A | 3/1999 | Andrus et al. | 482/7 |
| 5,890,995 | A | 4/1999 | Bobick et al. | 482/4 |
| 5,897,461 | A | 4/1999 | Socwell | 482/54 |
| 5,916,063 | A | 6/1999 | Alessandri | 482/4 |
| 5,931,763 | A | 8/1999 | Alessandri | 482/4 |
| 5,993,358 | A | 11/1999 | Gureghian et al. | 482/54 |
| 6,010,465 | A | 1/2000 | Nashner | 600/595 |
| 6,042,519 | A | 3/2000 | Shea | 482/57 |
| 6,053,844 | A | 4/2000 | Clem | 482/8 |
| 6,066,075 | A | 5/2000 | Poulton | 482/8 |
| 6,132,343 | A | 10/2000 | Eze | 482/97 |
| 6,135,924 | A | 10/2000 | Gibbs et al. | 482/54 |
| 6,152,854 | A | 11/2000 | Carmein | 482/4 |
| 6,152,856 | A | 11/2000 | Studor et al. | 482/8 |
| 6,159,131 | A | 12/2000 | Pfeffer | 482/8 |
| 6,193,631 | B1 | 2/2001 | Hickman | 482/28 |
| 6,227,968 | B1 | 5/2001 | Suzuki et al. | 463/7 |
| 6,312,363 | B1 | 11/2001 | Watterson et al. | 482/54 |
| 6,336,891 | B1 | 1/2002 | Fedrigon et al. | 482/8 |
| 6,416,444 | B1 | 7/2002 | Lim et al. | 482/54 |
| 6,447,424 | B1 | 9/2002 | Ashby et al. | 482/8 |
| 6,458,060 | B1 | 10/2002 | Watterson et al. | 482/54 |
| 6,514,199 | B1 | 2/2003 | Alessandri | 600/300 |
| 6,601,016 | B1 | 7/2003 | Brown et al. | 702/182 |
| 6,616,578 | B2 | 9/2003 | Alessandri | 482/8 |
| 6,626,799 | B2 | 9/2003 | Watterson et al. | 482/4 |
| 6,702,719 | B1 | 3/2004 | Brown et al. | 482/8 |
| 6,746,371 | B1 | 6/2004 | Brown et al. | 482/8 |
| 6,783,482 | B2 * | 8/2004 | Oglesby et al. | 482/54 |
| 6,863,641 | B1 | 3/2005 | Brown et al. | 482/8 |
| 6,866,613 | B1 | 3/2005 | Brown et al. | 482/8 |
| 6,918,858 | B2 | 7/2005 | Watterson et al. | 482/54 |
| 6,991,586 | B2 | 1/2006 | Lapcevic | 482/2 |
| 6,997,852 | B2 | 2/2006 | Watterson et al. | 482/1 |
| 7,060,006 | B1 | 6/2006 | Watterson et al. | 482/54 |
| 7,060,008 | B2 | 6/2006 | Watterson et al. | 482/54 |
| 7,070,539 | B2 | 7/2006 | Brown et al. | 482/8 |
| 7,128,693 | B2 | 10/2006 | Brown et al. | 482/1 |
| 7,166,062 | B1 | 1/2007 | Watterson et al. | 482/8 |
| 7,166,064 | B2 | 1/2007 | Watterson et al. | 482/54 |
| 7,196,604 | B2 * | 3/2007 | Sills et al. | 335/306 |
| 2002/0019258 | A1 | 2/2002 | Kim et al. | 463/36 |
| 2002/0045517 | A1 | 4/2002 | Ogelsby et al. | 482/51 |
| 2002/0055383 | A1 | 5/2002 | Onda et al. | 463/36 |
| 2002/0055419 | A1 | 5/2002 | Hinnebusch | 482/8 |
| 2003/0091966 | A1 | 5/2003 | Collodi | 434/247 |
| 2004/0018915 | A1 | 1/2004 | Reyes et al. | |

FOREIGN PATENT DOCUMENTS

| | | | |
|---|---|---|---|
| EP | 0941746 | A2 | 9/1999 |
| EP | 1188460 | A1 | 3/2002 |
| FR | 1 316 167 | | 1/1963 |
| GB | 2374424 | A | 10/2002 |
| WO | WO 9624286 | | 8/1996 |
| WO | WO 97/21471 | | 6/1997 |

* cited by examiner

FIG. 3
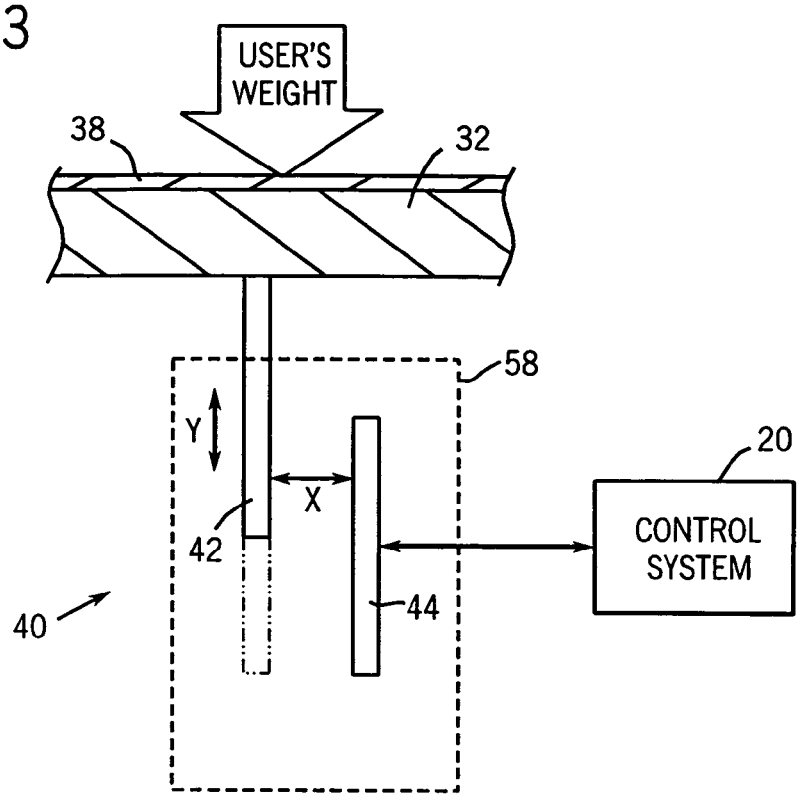
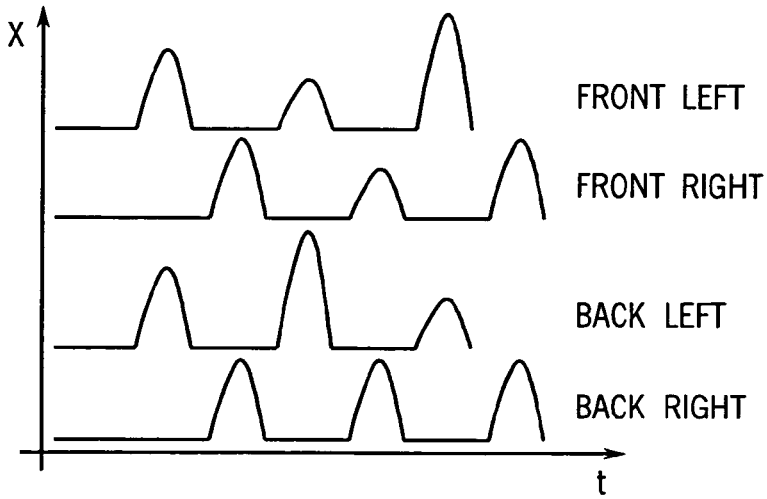
FIG. 5

PARAMETER SENSING SYSTEM FOR AN EXERCISE DEVICE

FIELD OF THE INVENTION

This invention relates to instrumentation and electronic control systems for fitness equipment. In particular, the invention relates to a parameter sensing system for exercise equipment. The parameters can include a user's presence and/or a user's position on an exercise device, and the speed and/or angle of inclination, of an exercise device.

BACKGROUND OF THE INVENTION

Many types of machines are used for fitness or sport training. Such machines are already known from their wide market availability for domestic, rehabilitation and commercial purposes. Treadmills, or running machines, are one of the most common forms of such machines. Treadmills typically include a support frame, a deck, an endless belt, a drive mechanism and a user interface. The endless belt typically extends over the deck and rotates around the deck and a pair of substantially parallel rollers to simulate the ground moving beneath a user as he or she walks or runs. The user interface associated with recently existing treadmills typically include a digital electronic control system with embedded software routines. Given the increasing functionality offered by digital electronics it is possible for the control system to store programs for different exercise routines, calorie-burning settings, timings, incline settings, speeds, etc. Users of such machines typically step on to the machine, enter their weight, choice of running program, desired speed or incline etc., and then begin to walk or run with the commencement of the belt's motion.

The belt motion typically ceases when the duration of the selected running program comes to an end, or when the user manually stops the belt by actuating one or more pushbuttons on the control panel. In other existing treadmills, a tether is used to releasably connect the user with the control system of the treadmill. The tether, typically a cord, string or cable, is often connected at a first end to the user and at a second end to the control panel of the treadmill. The length of the tether determines the distance the user can move away from the control panel. If the user moves away from the control panel beyond the predetermined distance, the second end of the tether disconnects from the control panel and the belt motion ceases.

Despite their widespread use, such existing treadmills have a number of drawbacks. Many users have difficulty entering their weight and starting the treadmill quickly. The digital electronic control systems with embedded software routines and increased functionality can sometimes be confusing, or even intimidating, for the user to properly use. Such confusion or intimidation caused by the machine's sophisticated user interface often effectively presents a barrier to widespread use, particularly by the elderly or technologically unsophisticated or those user's which may become embarrassed from their perceived ignorance in public fitness clubs or gymnasia.

For various reasons, such as those discussed above, it is often the case that the user does not enter his or her weight accurately. Consequently, the electronic control system is incapable of accurately calculating such useful information as calories burnt or intensity of training during a workout.

Also, particularly in busy fitness clubs and facilities, it is known that some users will step off the machine during their workout to get a drink, for example, but leave the machine's belt in motion. Whilst the first user is away from the machine it is possible for a second user to step on to the machine's moving belt without realising that the belt is moving. Such instances can also present a safety hazard. Although some existing devices incorporate the use of a tether in order to operate the machine, many find the use of tethers to be difficult to use, restricting, uncomfortable, and otherwise undesirable, and, as such, resist using the safety device. Other instrumentation, such as Linearly Variable Differential Transformers ("LVDTs") or strain gauges, can be incorporated into a treadmill design in order to detect the presence of a user on the treadmill, or to measure the impact of the user's gate as they run or walk on a machine. However, such instrumentation is typically prohibitively expensive, complex, and impractical to deploy on most commercially available machines for mass market use.

Furthermore, many existing treadmills, particularly those configured for home use, fail to provide sufficient safeguards to prevent the undesired use of the machine by children. The inadvertent actuation of the endless belt by a small child can present a safety hazard.

Additionally, typically exercise machines, such as treadmills, require the user to manually enter or adjust controls on the control or display panel of the exercise machine using the user's hands in order to adjust the speed of the exercise machine, such as the speed of the belt on a treadmill. Such manual action of the user's hand(s) and arm(s) is ergonomically awkward and inconvenient for the user.

Also, the monitoring of the speed and incline of exercise machines, such as treadmills, can be difficult due to the repeated loading of the machine by the user and the vibration generated in response to the operation of the machine by a user. Many existing devices used to monitor speed and incline of exercise machines are expensive, and often exhibit poor durability and reliability.

Thus, there is a continuing need for an exercise machine, such as a treadmill, to automatically detect the presence of a user on the machine in a reliable, cost-efficient manner. It would be advantageous to provide an exercise machine, which can automatically measure the weight of the user without requiring the user to navigate and manually enter his or her weight into the control system of the machine. What is also needed is an exercise machine, which quickly and automatically shuts down when the user leaves the machine. There is also a continuing need for an exercise machine that can readily distinguish between a grown user and a small child and adjust its operation accordingly. A need exists for an exercise machine, such as a treadmill, to automatically vary the speed of the machine (such as the speed of the belt of the treadmill) based upon the speed of the user on the machine without requiring the user to manually input a change in speed using his or her hand(s). What is also needed is sensors which can be used to reliably, effectively and cost-efficiently monitor the speed and/or incline of exercise machines, such as treadmills.

SUMMARY OF THE INVENTION

According to a principal aspect of the invention, a treadmill includes a frame, a deck assembly, at least one deck deflection sensor, and a control system. The deck assembly is supported by the frame. The deck assembly includes a longitudinally extending deck, at least first and second rollers, and a belt positioned about the deck and the first and second rollers. The deck deflection sensor is coupled to the deck. The deck deflection sensor is a contactless or non-contact displacement sensor including an electrical intermediate device and an aerial. The control system is operably coupled to the at least one deck deflection sensors.

According to another preferred aspect of the invention, a treadmill includes a frame, a deck assembly, at least one deck deflection sensor, a drive assembly, and a control system. The deck assembly is supported by the frame. The deck assembly includes a longitudinally extending deck, at least first and second rollers, and a belt positioned about the deck and the first and second rollers. The deck deflection sensor is coupled to the deck. The deck deflection sensor is configured to produce a signal representative of a weight applied to the deck. The drive assembly is coupled to one or both of the first and second rollers. The control system is operably coupled to the drive assembly and the deck deflection sensor. The control system configured to prevent the treadmill from operating until the signal received from the at least one deck deflection sensor exceeds a predetermined magnitude.

According to another preferred aspect of the invention, a treadmill is configured to detect a user's weight. The treadmill includes a frame, a deck assembly, at least one deck deflection sensor, and a control system. The deck assembly is supported by the frame. The deck assembly includes a longitudinally extending deck, and a belt operably supported by the deck. The deck deflection sensor is coupled to the deck. The deck deflection sensor includes at least one transmit winding, at least one receive winding, and an electrical intermediate device. Wherein the application of the user's weight to the deck assembly causes displacement of the electrical intermediate device, which produces a change in mutual inductance between the transmit and receive windings. The control system is operably coupled to the at least one deck deflection sensor. The control system is configured to electrically measure and correlate the change in mutual inductance between the transmit and receive windings into a deck displacement measurement.

According to another preferred aspect of the invention, a treadmill is configured for operation by a user. The treadmill includes a frame, a deck assembly, at least one aerial, a control system, and first and second electrical intermediate devices. The deck assembly is supported by the frame and includes a longitudinally extending deck, at least first and second rollers, and a belt positioned about the deck and the first and second rollers. The aerial is positioned proximate the deck and includes a set of transmit and receive windings. The control system is operably coupled to the transmit and receive windings. The control system is configured to supply an alternating electrical signal to the transmit windings. The first and second electrical intermediate devices are secured to the right and left legs of the user, respectively. Each intermediate device is configured to produce a variation in the mutual inductance existing between the transmit and receive windings in response to a change in the relative position of the intermediate device to the windings.

According to another preferred aspect of the invention, a treadmill includes a frame, a deck assembly, a drive assembly, at least one aerial and a control system. The deck assembly is supported by the frame and includes a longitudinally extending deck, at least first and second rollers, and a belt positioned about the deck and the first and second rollers. The drive assembly is coupled to one of the first and second rollers. The drive assembly includes a plurality of components configured to rotate about a common axis during use. The aerial is coupled to the frame and positioned adjacent to at least one of the components of the drive assembly. The aerial includes a non-cylindrical arrangement of transmit and receive windings. The control system is operably coupled to the speed sensor. The at least one component of the drive assembly is configured to produce a variation in the mutual inductance of the transmit and receive windings during use as the components moves relative to the aerial. The variation in mutual induction produced by the relative movement of the component to the aerial correlates to the speed of the treadmill.

According to yet another preferred aspect of the invention, a treadmill includes a frame, a deck assembly, at least one aerial, a control system, and an electrical intermediate device. The deck assembly is supported by the frame and has a forward end. The deck assembly includes a longitudinally extending deck, at least first and second rollers, and a belt positioned about the deck and the first and second rollers. The aerial is positioned proximate the forward end of the deck assembly. The aerial includes a set of transmit and receive windings. The lift assembly is coupled to the frame and includes an incline actuator and an actuating arm. The actuating arm is coupled to the forward end of the deck assembly. The control system is operably connected to the lift assembly and to the transmit and receive windings. The control system is configured to supply an alternating electrical signal to the transmit windings. The electrical intermediate device is coupled to the forward end of the deck assembly. The intermediate device is configured to produce a variation in the mutual inductance existing between the transmit and receive windings in response to a change in the relative position of the intermediate device to the windings.

This invention will become more fully understood from the following detailed description, taken in conjunction with the accompanying drawings described herein below, and wherein like reference numerals refer to like parts.

BRIEF DESCRIPTION OF THE DRAWINGS

FIG. 3 is a representative arrangement of a deck deflection sensor of the treadmill of FIG. 1.

FIG. 5 is a representative graph of deck deflection patterns resulting from four deck deflection sensors in spaced apart locations adjacent a deck of a treadmill in accordance with an alternative preferred embodiment of the present invention.

DETAILED DESCRIPTION OF PREFERRED EMBODIMENTS

Figure 1:
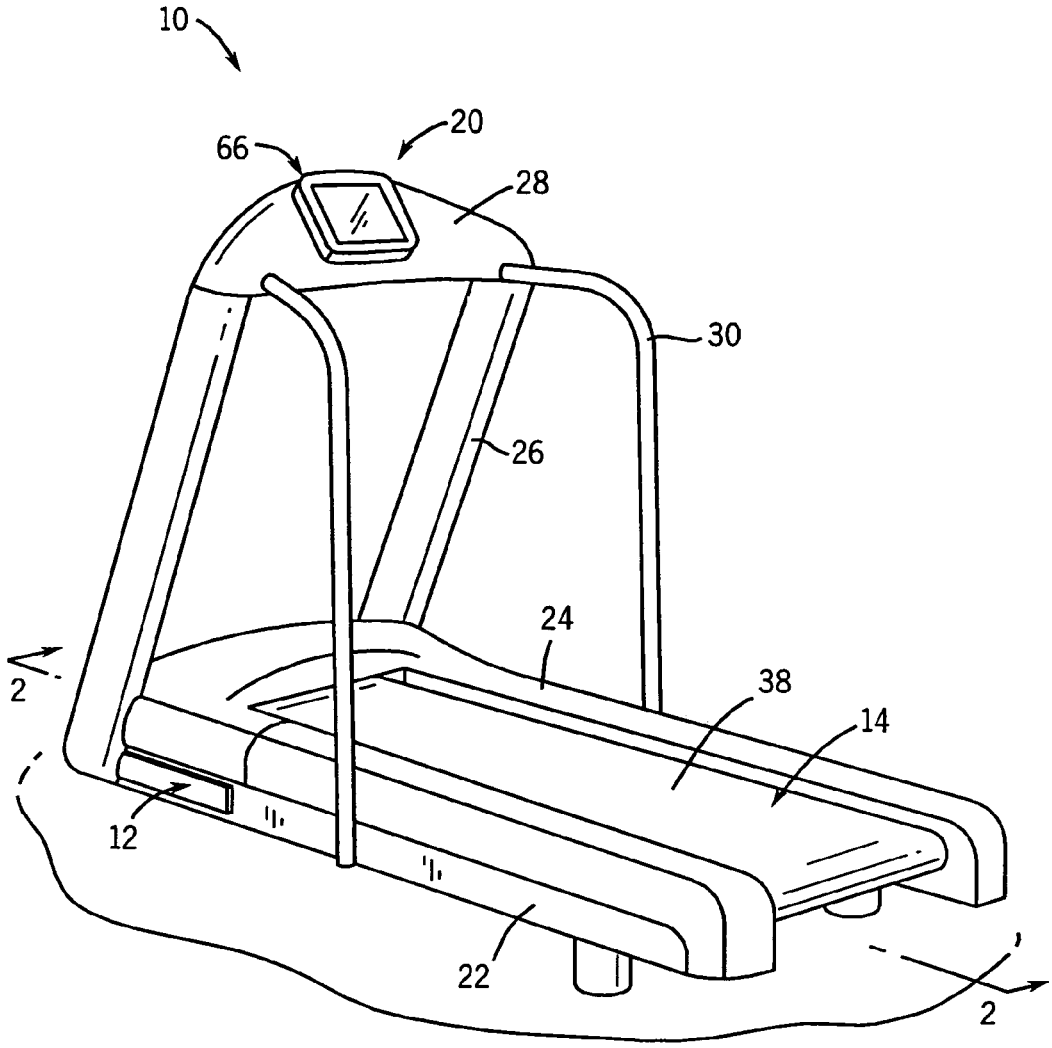
FIG. 1 is a side, rear perspective view of a treadmill in accordance with a preferred embodiment of the present invention.
Figure 2:
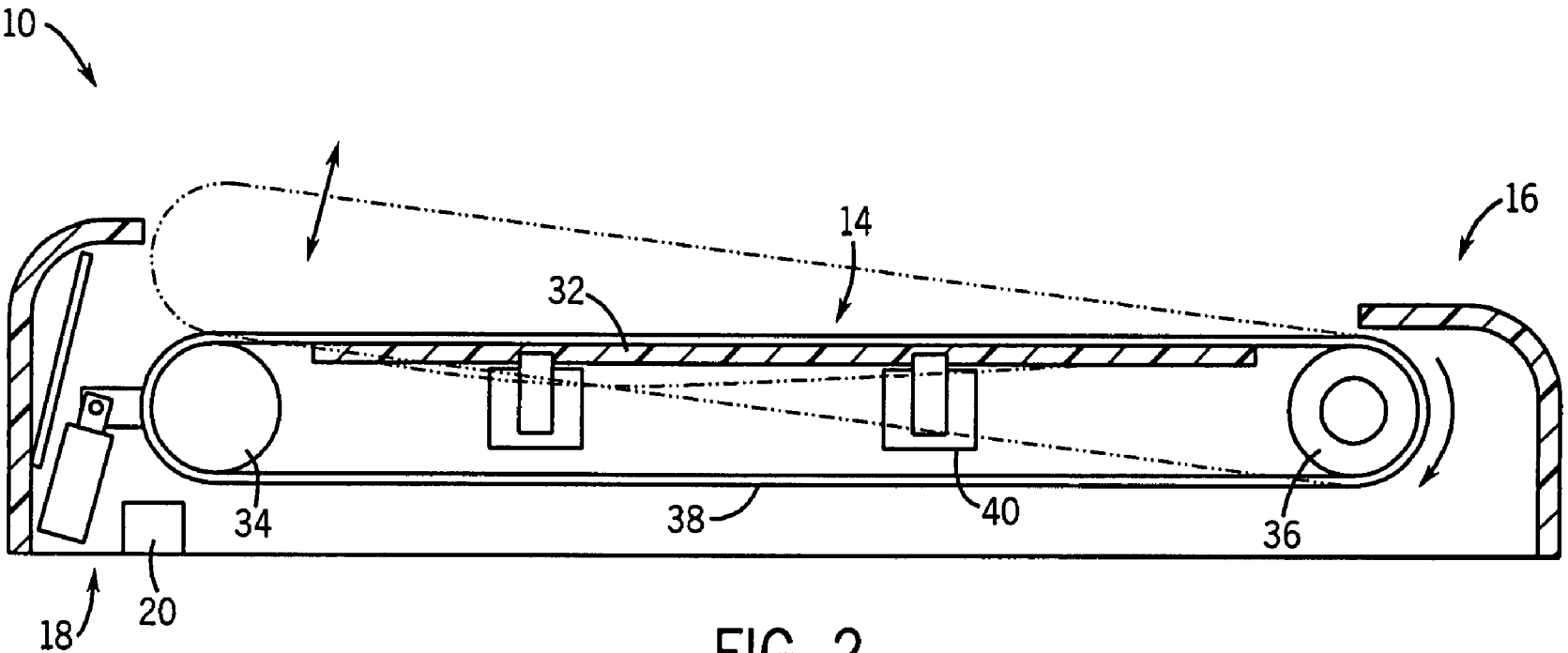
FIG. 2 is a longitudinal cross-sectional view of the treadmill taken along line 2-2 of FIG. 1.

Referring to FIGS. 1 and 2, an exercise machine, specifically a treadmill, is indicated generally at 10. The present invention is also applicable to other types of exercise machines, such as, for example, an elliptical exercise machine, a stair stepper and a cycling machine. The treadmill 10 includes a frame 12, operably supporting a deck assembly 14, a drive assembly 16, a lift assembly 18 and a control system 20. The frame 12 preferably includes first and second longitudinally extending sides 22 and 24, at least a pair of upwardly extending posts 26 interconnected at an upper end to a support plate 28, which generally spans the width of the deck assembly 14 and supports the control system 20, or a portion thereof. In a preferred embodiment, the frame 12 further includes a cross bar 30 upwardly extending from each side of the deck assembly 14 and extending across the deck assembly 14 adjacent the support plate 28. The frame 12 is formed of a tough, rigid, durable material, preferably steel with a rust-resistant, multi-layered powder coating. Alternatively, the frame can be formed of other materials, such as, for example, other metals, composite materials, and combinations thereof. In alternative preferred embodiments, the frame 12 can be configured with or without one or more upwardly extending posts, and with or without one or more upwardly extending cross bars.

The deck assembly 14 includes a deck 32, at least first and second substantially parallel rollers 34 and 36 and an endless belt 38 extending around the first and second rollers 34 and 36 and over the deck 32. The deck 32 is a generally rectangular, longitudinally extending planar structure disposed between the first and second sides 22 and 24 of the frame 12, and adjacent to the first and second rollers 34 and 36. The deck 32 provides a running or walking surface beneath, and supporting, the portion of the belt 38 extending over the upper surface of the deck 32. The deck 32 is formed of a durable, generally resilient material, preferably a high density fiberboard core laminated with a phenolic laminate. Alternatively, the deck can be formed of other materials, such as, for example, plywood, and other fiberboard compositions. The deck 32 is configured to deflect as the user moves and transfers his or her weight to different parts of the deck. For example, if the user is running and plants his or her left foot down at the top left corner of the deck, maximum deflection will occur there and to a lesser extent elsewhere.

The first and second rollers 34 and 36 extend between and rotatably couple to the first and second sides 22 and 24 of the frame 12 at front and rear portions of the frame 12, respectively. The endless belt 38 longitudinally extends along the upper surface of the deck 32 around a portion of the first roller 34, back through the frame 12, and around a portion of the second roller 36 to form a closed endless loop. The width of the belt 38 is preferably generally equal to, or slightly less than, the width of the deck 32. The belt 38 is formed of a resilient, durable material, preferably a multi-weave polyester. Alternatively, the belt can be formed of other materials, such as, for example, other elastomeric materials and other polymers. In an alternative preferred embodiment, the shape of the deck assembly, when viewed along a vertical longitudinal plane, is generally arcuate.

Referring to FIGS. 2 and 3, the deck assembly 14 further includes at least one deck deflection sensor 40 positioned adjacent to the lower surface of the deck 32. In one preferred embodiment, the deck assembly 14 preferably includes six deck deflection sensors 40 positioned in spaced about locations adjacent to the lower surface of the deck 32. In alternative preferred embodiments, other numbers of deck deflection sensors in spaced apart locations on, about, or beneath, the deck 32 can be used.

Figure 4:
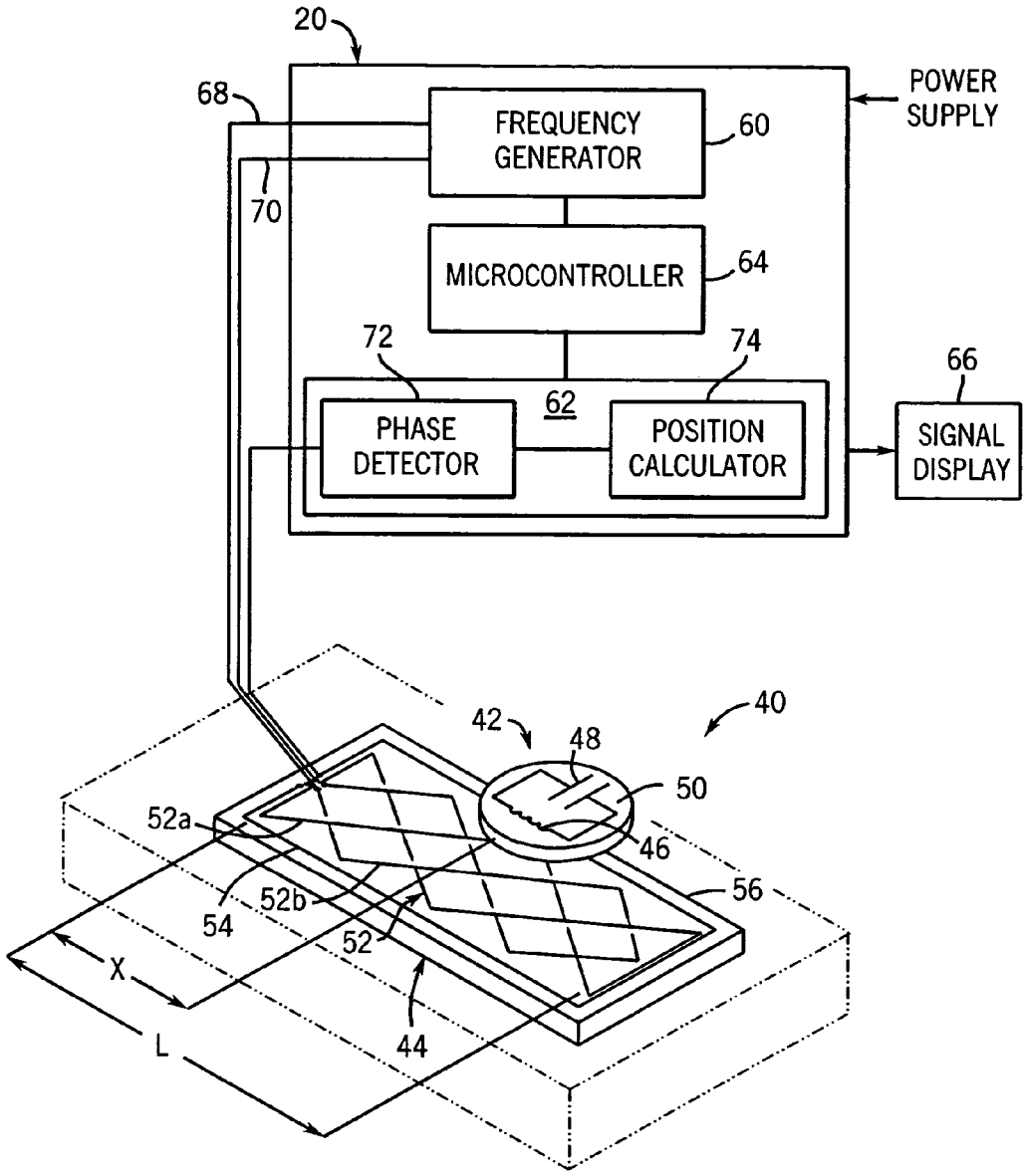
FIG. 4 is a representative arrangement of transmit and receive windings and an electrical intermediate device of the deck deflection sensor of FIG. 3 and a block diagram of a control system coupled to the deck deflection sensor.

Referring to FIGS. 3 and 4, the deck deflection sensor 40 is a displacement sensor configured to measure deck deflection in a contactless or contact-free manner. The deck deflection sensor 40 is configured to measure the movement or deflection of the deck 32 caused by application of a user's foot during walking, running or standing on the treadmill 10. The deflections resulting from walking or running on the treadmill 10 form a unique pattern according to the engineer's plate bending theory for a given amount of loading at a particular point.

In a preferred embodiment, the deck deflection sensor 40 includes an electrical intermediate device 42 and an aerial 44. The intermediate device 42 is an indicating element or target, whose displacement alters the electrical inductance between the windings of the aerial 44. Preferably, the intermediate device 42 includes a passive resonant circuit. In a particularly preferred embodiment, the intermediate device 42 comprises a resonant "LC" circuit including an inductance (L) 46 in the form of a coil of conductive tracks or wires, and a capacitor (C) 48, in series. Most preferably, the coil of the inductance 46 is formed as a series of spiralled tracks on a printed circuit board 50 and the capacitor 48 soldered in series with the tracks. The intermediate device 42 is preferably removably connected to the lower surface of the deck 32, and positioned adjacent to the aerial 44, preferably within 0.1 to 100 mm of the aerial 44. Alternatively, the intermediate device 42 can be fixedly secured to the deck, coupled to the deck, or placed directly adjacent to the deck. The sensor is substantially similar to the sensing apparatus described in UK Patent Application No. GB 2374424 filed on Jul. 31, 2002.

The natural frequency ($f^n$) of the intermediate device 42 is calculable by the formula:

$$f_n = \frac{1}{2\pi\sqrt{LC}}$$

Preferably, the LC circuit of the intermediate device 42 has a natural resonant frequency in the range 100 kHz to 10 MHz for good levels of signal coupling without the requirement for expensive, high frequency electronics. Alternatively, the intermediate device 42 can be formed with other natural resonant frequency ranges.

In alternative preferred embodiments, the intermediate device can be a conductive metal target or ferrite slug. An LC resonant circuit is preferred however due to the resultant increased signal amplitude, signal quality factor and signal to noise ratio associated with the LC resonant circuit. In another alternative preferred embodiment, the previously described electrically passive intermediate device 42 can be an electrically active component powered by a power supply such as a battery. Such an electrically active embodiment is preferable if the distance between the intermediate device and the aerial exceeds 100 mm.

The aerial 44 is a sensing unit, which includes an arrangement of transmit windings 52 and receive windings 54. In a preferred embodiment, the aerial 44 is has a generally planar shape. In alternative preferred embodiments, the aerial 44 can be formed in other shapes to suit the specific mechanical geometry of the it's location and, in particular, the location and motion of the intermediate device 42, such as, for example, a cylindrical shape, a curved shape forming part of a cylinder, a hemi-spherical shape and an arcuate shape.

The transmit and receive windings 52 and 54 are preferably formed as tracks on a multi-layer printed circuit board 56. Each aerial 44 preferably has a separate, single intermediate device 42 corresponding to it during operation. Alternatively, two or more intermediate devices 42 of substantially differing resonant frequencies can be used with a single aerial 44. The aerials 44 are operably coupled to the control system 20, and mechanically coupled to the frame 12 at locations adjacent to the intermediate device 42. The aerials 44 can be connected to the frame 12 through mechanical fasteners, adhesives, or other conventional fastening means. The aerial 44 is preferably positioned within 0.1 to 100 mm from the intermediate device 42. In other preferred embodiments the distance between the aerial 44 and the intermediate device 42 can be greater than 100 mm.

Referring to FIGS. 3 and 5, in a preferred embodiment the transmit windings 52 are energised with an alternating electrical signal supplied through the control system 20, so as to produce a local alternating electromagnetic field 58. In operation, deflection of the deck 32 causes the intermediate device 42 to move downward relative to the aerial 44 and within the limits of minimum and maximum deck deflection. The alternating magnetic field 58 is preferably at substantially the same frequency as the resonant frequency of the intermediate device 42. As the deck 32 deflects, the intermediate device 42 moves along the alternating electromagnetic field causing the mutual inductance between the transmit windings 52 and receive winding 54 to vary in relation to the deck deflection. The accuracy of the signal produced by the receive windings 54, and corresponding to the deck deflection, is generally not negatively affected by variations in the stand-off distance within the allowed range of 0.1 to 100 mm. The stand-off distance is the 0.1 to 100 mm distance separating the intermediate device 42 from the aerial 44. Accordingly, referring to FIG. 3, as the intermediate device 42 moves relative to the aerial 44 in a direction, y, along the aerial 44, variation in the stand-off distance, x, between 0.1 to 100 mm, does not negatively affect the deck deflection measurement taken along the direction, y. In an alternative preferred embodiment, the intermediate device can be coupled to the frame and the aerial can be coupled to the deck such that upon application of a load onto the deck, the aerial moves downward relative to the intermediate device.

FIG. 4 illustrates the intermediate device 42, as a resonant circuit, co-operating with an arrangement of the transmit and receive windings 52 and 54. The transmit windings 52 are arranged as a first and second electrically separate generally sinusoidal and cosinusoidally or 90 degree phase shifted wound circuits 52*a* and 52*b* which are formed on two layers of the printed circuit board 56 over a pitch or wavelength L. Alternatively, the transmit windings can be configured in other phased intersecting arrangements. The printed circuit board 56 is conductively plated through holes to form the inter-layer electrical connections for each winding. In a particularly preferred embodiment, the printed circuit board 56 of the transmit and receive windings 52 and 54 and the printed circuit board 50 of the intermediate device 42 include photo-etched copper tracks or printed conductive tracks on an insulating substrate. Alternatively, simple windings of conductive wire or cable with an insulated cover are also feasible. However, printed circuit boards are preferable due to their ease and low cost of manufacture relative to high accuracy.

The receive windings 54 are formed as a simple loop extending along and around the transmit windings 52. The shape of the loop formed by the receive windings 54 is preferably generally rectangular. Alternatively, the shape of the loop can be generally oval, circular, polygonal and irregular. It will be obvious to those skilled in the art that yet other arrangements are also feasible.

The intermediate device 42 is preferably positioned to be substantially parallel to, and within 0.1 to 100 mm of, the transmit and receive windings 52 and 54 of the aerial 44. Alternatively, the intermediate device 42 may move normally to the transmit and receive windings 52 and 54. In such arrangements an alternative sensing algorithm to that previously described is required. For example, an alternative algorithm would be to correlate the variation in received signal amplitude to relative displacement.

Referring to FIG. 4, the control system 20 is shown in greater detail. The control system 20 is operably coupled to the deck deflection sensors 40, the drive assembly 16 (see FIG. 2), and the incline assembly 18 (see FIG. 2), and controls the operation of the drive and incline assemblies 16 and 18. A power supply is electrically coupled to, and energizes, the control system 20, the deck deflection sensors 40, the drive assembly 16 and the incline assembly 18. The control system 20 includes a frequency generator 60, a set of receive electronics 62, a micro-controller 64, and a display panel 66. The components of the control system 20 are preferably positioned at multiple locations about the frame 12. In one preferred embodiment, the display panel 66 is positioned on the support plate 28 (see FIG. 1) of the frame 12, and the remaining components of the control system 20 can be positioned between the first and second sides of the frame 12. Alternatively, the components of the control system 20 can be positioned at any location on or about the frame 12. In one preferred embodiment, the control system 20 has a single micro-controller 64 (or microprocessor), a single frequency generator 60, a single set of receive electronics 62, and a single display panel 66. If a single micro-controller or microprocessor is used, sufficient bandwidth must be available for the micro-controller or microprocessor to carry out frequent deck deflection measurements without interrupting the operation of other control system functions performed by the micro-controller or microprocessor. In an alternative preferred embodiment, each deck deflection sensor 40 has its own dedicated micro-controller or microprocessor, or any combination of one or more frequency generators, sets of receive electronics, micro-controllers, and displays.

The frequency generator 60 provides an alternating electrical signal to the transmit windings 52 to produce the local alternating electromagnetic field 58, which is substantially the same frequency as the resonant frequency of the intermediate device 52. The alternating transmit signals energizing the transmit windings 52 are generated using an oscillating circuit source, preferably a 16 or 32 MHz crystal oscillating circuit source, reduced down to suit the resonant frequency of the intermediate device 42, and fed in to the transmit windings 52 via the control system 20. Power sources of other sizes and types can also be used. In particular, referring to FIGS. 4 and 5, the frequency generator 60 produces first and second phase shifted signals 68 and 70 to the first and second wound circuits 52*a* and 52*b* of the transmit windings 52. The electric signals of the frequency generator 60 produce a mutual inductance between the transmit and receive windings 52 and 54. As the intermediate device 42 moves relative to the aerial 44, due to the deflection of the deck 32, the mutual inductance between the transmit and receive windings 52 and 54 varies in relation to the amount of deck deflection.

The control system 20, including the set of receive electronics 62 and the micro-controller 64, is preferably also capable of comparing the combined received signals from the receive windings 54, with the voltage and phase of the transmitted signals of the transmit windings 52, such that the variation according to the actual position of the intermediate device 42 can be calculated against a preset or theoretical variation of mutual inductance. The set of receive electronics 62 includes a phase detector 72 and a position calculator 74. The output of the set of receive electronics 62, in particular the output of the position calculator 74, is operably coupled to the microcontroller 64 and the display 66.

The control system 20 is configured to process the signals of the deck deflection sensors 40 and to utilize the deck deflection information in a variety of useful ways. The deck deflection sensor(s) 40 can be used to automatically measure the weight of a user positioned on the deck of the treadmill. The automatic weight calculation eliminates the need for the user to manually enter his or her estimated weight into the control system 20 of the treadmill before commencing operation of the treadmill. The automatic calculation of user weight also eliminates the error associated with the user's estimate of his or her own weight. The user weight information can then be used for calculating information relating to the user's workout or for use in setting other machine parameters such as resistance level.

Additionally, the control system 20 can include a first predetermined deflection or weight setpoint. The control system 20 is then configured to prevent the treadmill 10 from operating unless the weight of the user meet or exceeds the first predetermined setpoint. The first predetermined setpoint can be a fixed value, or a value that can be adjusted as necessary. The first predetermined setpoint is configured to correlate to a minimum weight of a user. Accordingly, the first predetermined setpoint can be set at any predetermined weight value to accomplish the desired inadvertent start prevention feature. In one particularly preferred embodiment, the first predetermined setpoint corresponds to a user weight of 30 pounds. In alternative particularly preferred embodiments, the predetermined setpoint can be set to correspond to other weight settings, such as, for example, 40 pounds, 50 pounds, and 60 pounds. The first predetermined setpoint, therefore, prevents the inadvertent actuation of the machine by a small child, and virtually eliminates the risk of a small child climbing onto a treadmill deck and activating the treadmill.

Further, the control system 20 can include a second predetermined deflection or weight setpoint. The second predetermined setpoint is configured to cease or terminate operation of the treadmill if the weight of the user on the treadmill drops below the second predetermined setpoint for a first predetermined amount of time. The second predetermined setpoint can be set to correspond to a weight below that of a typical user. In one particularly preferred embodiment, the second predetermined setpoint corresponds to a user weight of 70 pounds. In alternative particularly preferred embodiments, the second predetermined setpoint can be set to correspond to other weight settings, such as, for example, 60 pounds, 50 pounds, and 40 pounds.

Alternatively, the second predetermined setpoint can be set as a percentage of the particular user's weight, such as, for example, 80 percent of the user's weight, 70 percent of the user's weight, etc. As an example, if the second predetermined setpoint is set at 70 percent of the user's weight, if a user weighing 200 pounds leaves an operating machine, if the weight on the deck 32 of the treadmill remains less than 140 pounds for the duration of first predetermined time period, the control system 20 will cease the operation of the treadmill 10.

The first predetermined time period can be fixed or adjusted as necessary. In one particularly preferred embodiment, the first predetermined time period is five seconds. In other particularly preferred embodiments, other time periods can be used, such as, for example, 2 seconds, 3 seconds, and 10 seconds. This automatic shutdown feature will automatically shutdown the treadmill 10, in the event the user falls from the treadmill, or leaves the treadmill without shutting the treadmill down. Thus, if the user leaves the treadmill 10 without shutting the treadmill down, the deflection sensors 40 will detect the reduction, or absence of, deck deflection (or user weight) and produce a corresponding signal to the control system 20. If the signal corresponds to a weight that is less than the second predetermined value, and the signal remains for a period of time beyond the first predetermined time period, the control system will automatically shutdown the treadmill 10, or simply stop the movement of the belt 32 of the treadmill 10 and place the controls in a standby mode.

When multiple deck deflection sensors 40 are employed on the deck 32 of the treadmill 10, the control system 20 can be configured to differentiate between the deck deflection sensors 40 and to determine the impact pattern of the user's feet on the deck 32. Such information can be used to adjust the speed or incline of the machine, or to warn the user that user is operating the treadmill at a location too close to either side edge of the belt of the treadmill. Such impact pattern information can also be used to perform stride length calculations and diagnostics.

Figure 6:
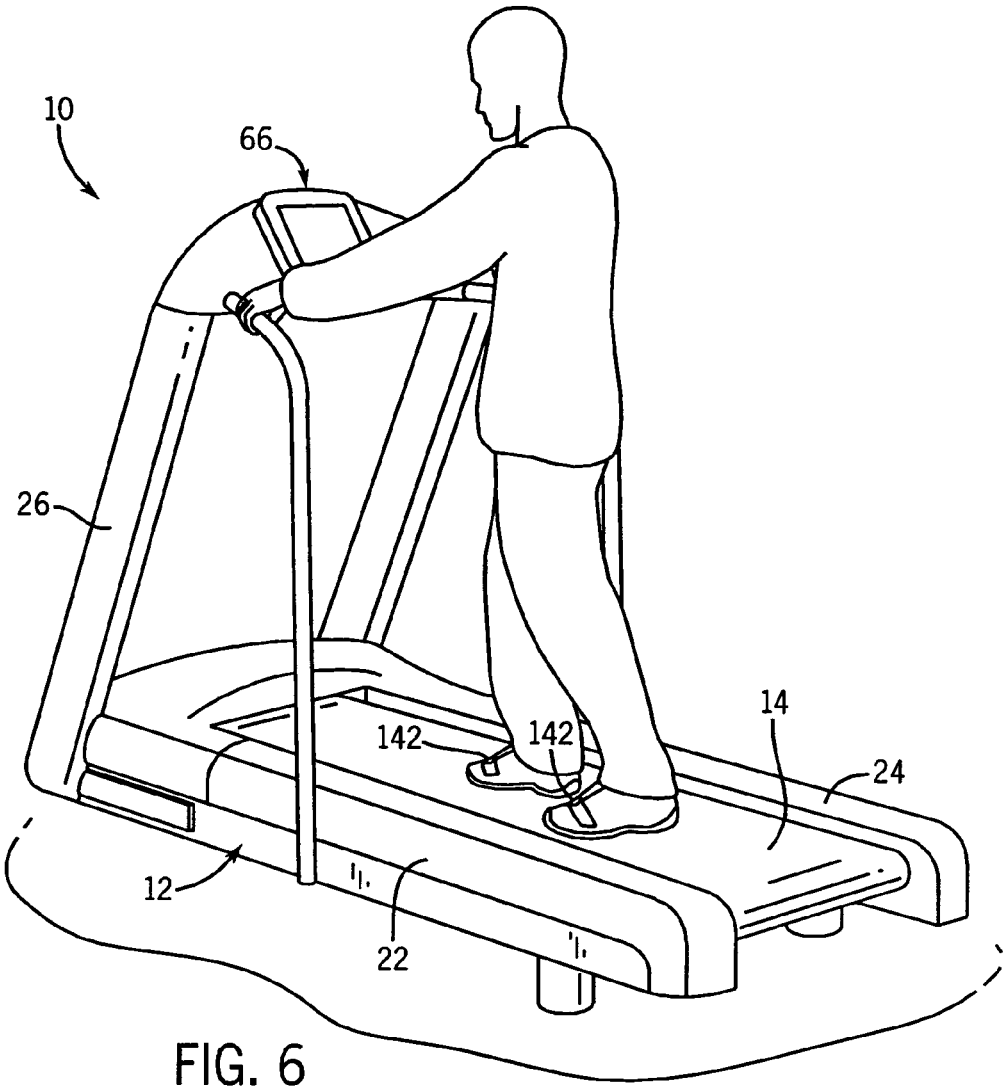
FIG. 6 is a side, rear perspective view of a user on the treadmill in accordance with an alternative preferred embodiment of the present invention.

FIG. 6 shows a schematic of an example trace from 4 deck deflection sensors showing deflection (X) over time (t). The vertical offset of the various traces is shown for reasons of clarity. In this example the four sensors are arranged at four locations around or under the deck—front left, front right, rear left and rear right. Such an arrangement is only one of many possible arrangements, which may be deployed for maximum data with more sensors or maximum economy with fewer sensors. From the example arrangement it is possible to differentiate between impacts made by the user's left and right leg; left leg produces greater deflection on the front left sensor compared to smaller but concurrent deflection of the front right sensor and vice versa. Further, it is also possible to infer the user's lateral or longitudinal position by comparing impacts or deflections from each of the various sensors. Such longitudinal information is particularly valuable as it provides data to enable automatic motor speed control; speeding up as the user nears the front of the machine or slowing down as the user nears the back of the belt.

The number of impacts over a given time can be calculated and compared with the distance travelled by the belt and hence data on stride length or stride pattern compared to the speed and incline of the machine can usefully be generated for diagnosis of the user's performance.

The deck deflection sensors of the present invention enable deck deflection of the treadmill to be measured in an accurate, reliable, a relatively inexpensive and non-complex manner. The deck deflection sensors of the present invention are significantly less expensive than other commonly used instruments, such as, linear differential transformers, ultrasonic sensors, and optical sensors. Because the non-contact deflection sensors of the present invention are not negatively affected by variations in the stand-off distance within 0.1 to 100 mm, the tolerances of the components supporting the intermediate device and aerial of the deflection sensor do not have to be as tightly maintained as required by many existing conventional sensors.

Figure 7:
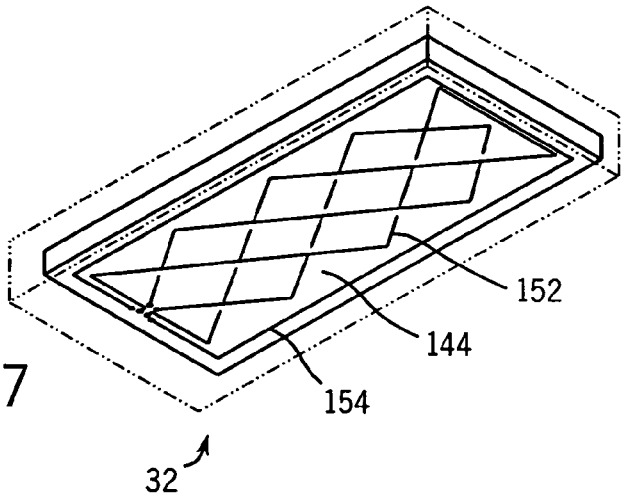
FIG. 7 is a perspective of the deck of the deck assembly of the treadmill of FIG. 6 including an aerial.

Referring to FIGS. 6 and 7, in an alternative preferred embodiment, the position of a user on the treadmill 10 is sensed using at least one aerial 144 and at least one electrical intermediate device 142. The aerial 144 is substantially the same as the aerial 44. The aerial 144 is coupled to the deck 32, preferably in a position that is substantially coplanar with the deck 32. The aerial 144 also preferably extends over substantially the entire usable portion of the deck 32. Referring to FIG. 7, in one particularly preferred embodiment, the aerial 144 is mounted to the lower surface of the deck 32. In other embodiments, the aerial can be disposed within the deck or in a position adjacent to and substantially parallel with, the deck. In other alternative preferred embodiments, multiple aerials can be employed in a spaced apart arrangements about the deck. The aerial 144, like the aerial 44 includes an arrangement of transmit and receive windings 152 and 154, which are substantially similar to the windings 52 and 54. The aerial 144 is operably coupled to the control system 20.

The electrical intermediate device 142 is substantially the same as the intermediate device 42. Referring to FIG. 6, in one particularly preferred embodiment, a separate electrical intermediate device 142 is coupled to each leg of the user. The intermediate device 142 can be attached to the user's shoe, ankle (such as through an ankle strap), lower leg, or knee (such as through a knee strap). Like the intermediate device 42, the intermediate device 142 causes the mutual inductance between the transmit windings 152 and the receive windings 154 to vary in relation to the location of the intermediate device 142 on the deck 32. The control system 20 monitors the mutual inductance from the windings 152 and 154 of the aerial 144 to identify the position of the user on the treadmill. Based upon these signals, or variations in the mutual inductance, the control system can determine the user's position, including fore and aft as well as right and left.

The control system 20 can be configured to emit audible warning signals to the user based upon the user's position. The audible signals can be generated directly from the control system 20 or from one or more speakers (not shown), or other sound generating device, mounted in the treadmill. For example, if the user drifts too far to the right of the treadmill during use, the treadmill 10 can emit a first audible warning signal to alert the user to change his or her position. Similarly, if the user drifts too far to the left of the treadmill during use, the treadmill 10 can emit a second audible warning signal. Likewise, if the user is too forward or rearward on the deck the treadmill can emit third and/or fourth audible warning signals to alert the user. The audible warning signals can be specific tones, or specific voice warnings. Such a configuration, would be of particular benefit to blind users who can rely on the audible warning signals to maintain proper position on the treadmill.

Further, in an alternative preferred configuration, the fore and aft positions of the user on the deck 32 can be used to adjust the speed the treadmill 10. The control system 20, which is coupled to the drive assembly 16, can cause the speed to increase if the user is in a forward position on the deck, and decrease if the user is in a rearward position on the deck 32. In yet another configuration, the user's position on the treadmill 10 can be used to automatically control the speed of the treadmill 10. The control system 20 can be configured to increase the speed of the treadmill 10, if the user takes a position toward the right side of the deck 32, or decrease the speed, if the user takes a position toward the left side of the deck 32 during use. This right/left speed adjustment configuration may be more suited for shorter length treadmills.

The aerial 144 and intermediate devices 142 can also be used to enable the user to automatically adjust or control the incline of the deck 32 by varying the user's position on the treadmill 10 during use. Through its connection with the lift assembly 18, the control system 20 can be configured to induce the lift assembly 18 raise the forward portion of the deck 32, or increase the angle of incline of the deck 32, if the user takes a forward position on the deck 32. Conversely, the control system 20 cause the lift assembly 18 to automatically lower the incline of the deck 32, if the user takes a rearward position on the deck 32.

Unlike other existing technologies, such as sonic sensors or IR sensors, which are expensive, and often unreliable, the present invention using inductive position sensing, provides a reliable, cost effective means of automatically controlling or adjusting the operation of a treadmill. Further, the present invention doesn't require additional mounting of equipment onto handrails or displays of the treadmill.

Figure 8:
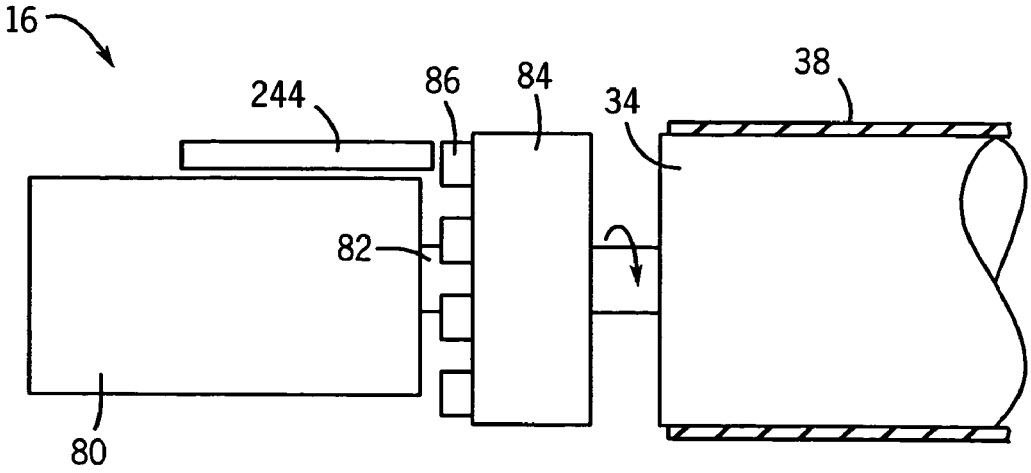
FIG. 8 is a side view of the drive assembly of a treadmill in accordance with an alternative preferred embodiment of the present invention.

Referring to FIG. 8, an another alternative embodiment of the present invention is illustrated. An aerial 244 is supported by the frame or other structure of the treadmill, and is positioned adjacent to a rotating component of the treadmill 10, to function as a contactless speed sensor. The aerial 244 is substantially the same as the aerial 44 and includes an arrangement of transmit and receive windings, which are substantially the same as the windings 52 and 54. In one preferred embodiment, the aerial 244 is positioned adjacent to the drive assembly 16, which includes a motor 80, an output shaft 82, and a flywheel 84. The motor 80 is electrically coupled to the control system 20 and to a power supply, and directly connected to the output shaft 82. The output shaft 82 is coupled to the flywheel 84 and to one of the rollers 34. The motor 80 causes the output shaft 82, as well as the flywheel 84 and the roller 34 to rotate, thereby driving the belt 38 of the treadmill 10.

In a preferred embodiment, the flywheel 84 includes at least one outwardly projecting constellation 86, and preferably a plurality of constellations 86. The flywheel 84 is positioned adjacent the aerial 244 such that the constellations 86 act as one or more electrical intermediate devices. The rotational movement of the constellations about the aerial 244 causes a variation in the mutual inductance of the transmit and receive windings 252 and 254 of the aerial 244. The control system 20 monitors this variation of mutual inductance to determine the rotational speed of the flywheel 84 and the shaft 82. In alternative preferred embodiments, the aerial can be positioned to other rotational members of the treadmill including the rotor of the motor, the output shaft, or one of the rollers. Further, the electrical intermediate device can be other conductive metal targets, a ferrite slug, a resonant LC circuit, or an electrically active component powered by a battery. The contactless configuration of this speed sensing aerial provides a low cost, reliably and accurate means of monitoring the speed of the treadmill without producing undesirable drag or resistance on the drive assembly.

Figure 9:
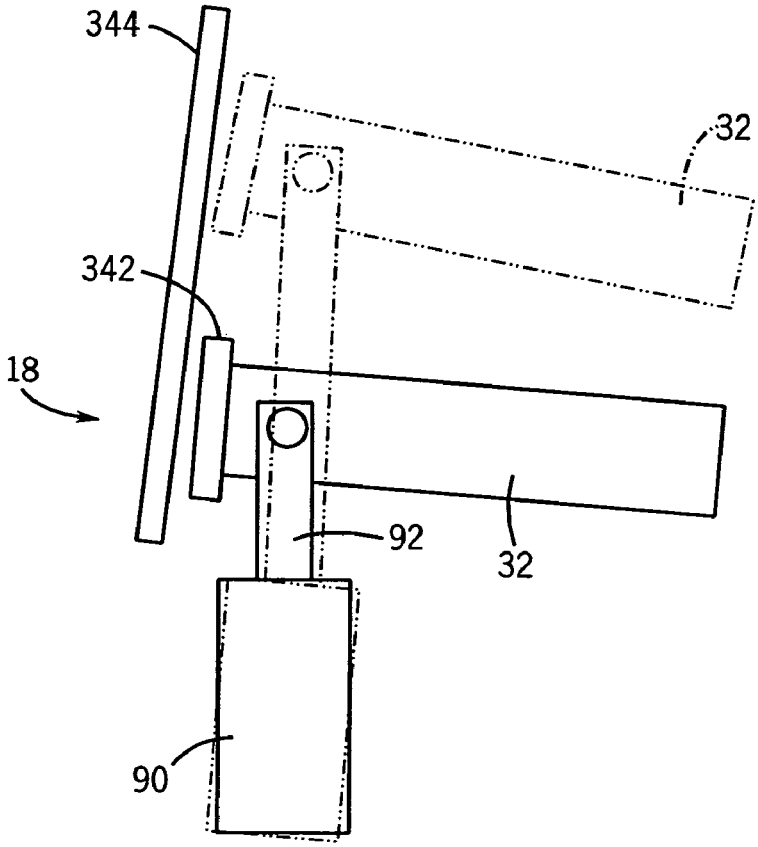
FIG. 9 is a side view of the lift assembly of a treadmill in accordance with an alternative preferred embodiment of the present invention.

Referring to FIG. 9, an another alternative embodiment of the present invention is illustrated. An aerial 344 is supported by the frame or other structure of the treadmill, and is positioned adjacent to a forward end 90 of the deck assembly 14, to function as a contactless incline sensor. The aerial 344 is substantially the same as the aerial 44 and includes an arrangement of transmit and receive windings, which are substantially the same as the windings 52 and 54. In one preferred embodiment, the aerial 244 is positioned adjacent to the lift assembly 18, which includes a lift actuator 92 and an actuating arm 94. The lift actuator 92 is electrically coupled to the control system 20 and to a power supply. The actuating arm 94 is coupled to the forward end 90 of the deck assembly 14. In operation, the lift actuator 92 causes displacement of the actuating arm 94 which raises or lowers the height of the forward end 90, thereby varying the incline, of the deck assembly 14.

An electrical indicating device 342 is coupled to the forward end 90. Like the intermediate device 42, the intermediate device 342 causes the mutual inductance between the transmit and receive windings to vary in relation to the location of the intermediate device 342 relative to the frame 12. The control system 20 monitors the mutual inductance from the windings of the aerial 344 to identify the position of the forward end 90 of the deck assembly 14. Based upon these signals, or variations in the mutual inductance, the control system 20 can determine the incline of the deck assembly 14.

The control system 20 can be configured with a single micro-controller 64 (or microprocessor), a single frequency generator 60, a single set of receive electronics 62 for processing the signals or variation in inductance in the winding of one, two or all of the aerials 44, 144, 244 and 344 of the treadmill 10. Alternatively, each aerial 44, 144, 244 or 344, or group of 2 or more aerials, can have its own dedicated micro-controller or microprocessor, or any combination of one or more frequency generators, sets of receive electronics, micro-controllers, and displays.

While the preferred embodiments of the present invention have been described and illustrated, numerous departures therefrom can be contemplated by persons skilled in the art. For example, in an alternative preferred embodiment, the deck deflection sensor can be configured without an electrical intermediate device, and the transmit and receive windings can be positioned on two separate bodies. In this configuration separate electrical connections are required for each of the transmit and receive windings. Therefore, the present invention is not limited to the foregoing description but only by the scope and spirit of the appended claims.

What is claimed is:

1. A treadmill, comprising:

a frame:

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings;

a control system operably coupled to the at least one deck deflection sensor, wherein at least one deck deflection sensor is a plurality of spaced apart deck deflection sensors, wherein each deck deflection sensor produces a signal representative of the deflection of a separate region of the deck, and wherein the control stem is configured to process the signals from the deck sensors and to differentiate between the deck sensors, wherein the control system is configured to determine specific operating characteristics of a user of the treadmill based upon the signals from the deck deflection sensors from the separate regions of the deck; and a drive assembly coupled to one of the rollers and the control system, wherein the control system sends a speed signal to the drive assembly to adjust the speed of the belt based upon at least one operating characteristic of the user.

2. The treadmill of claim 1, wherein the at least one deck deflection sensor is at least four deck deflection sensors positioned in a spaced-apart locations about the deck.

3. The treadmill of claim 1, wherein the at least one deck deflection sensor is at least six deck deflection sensors positioned in a spaced-apart locations about the deck.

4. The treadmill of claim 1, wherein the electrical intermediate device is selected from the group consisting of: a passive resonant electrical circuit, a powered resonant electrical circuit, a resonant LC circuit, a conductive metal slug, and a conductive ferrite slug.

5. The treadmill of claim 1, wherein the non-cylindrical arrangement of transmit and receive windings is planar.

6. The treadmill of claim 1, wherein the non-cylindrical arrangement of transmit and receive windings is an aerial, and wherein the shape of the aerial is selected from the group consisting of a curved shape forming part of a cylinder, a hemi-spherical shape and an arcuate shape.

7. The treadmill of claim 1, wherein the electrical intermediate device includes a resonant LC circuit, and wherein the distance separating the device and the arrangement of transmit and receive windings is within the range of 0.1 to 100 mm.

8. The treadmill of claim 7, wherein the separation between the electrical intermediate device and the aerial is measured along a first direction, and wherein as the electrical intermediate device moves with respect to the aerial in a second direction, different from the first direction, the accuracy of the deck deflection sensor is not significantly negatively affected by variations in the separation distance range between 0.1 to 100 mm.

9. The treadmill of claim 1, wherein control system is configured to automatically shutdown the treadmill if the signal produced by the deck deflection sensor drops below a predetermined value for a predetermined amount of time.

10. The treadmill of claim 9, wherein the predetermined value of the signal produced by the deck deflection sensor corresponds to a non-zero weight of less than 70 pounds.

11. The treadmill of claim 9, wherein the predetermined value of the signal produced by the deck deflection sensor corresponds to a non-zero weight of less than 60 pounds.

12. The treadmill of claim 9, wherein the predetermined value of the signal produced by the deck deflection sensor corresponds to a non-zero weight of less than 50 pounds.

13. The treadmill of claim 9, wherein the predetermined amount of time is less than or equal to five seconds.

14. The treadmill of claim 1, wherein the operating characteristics are selected from the group consisting of stride length, user's speed, user's deck impact pattern, stride diagnostics, user's lateral position, user's longitudinal position and combinations thereof.

15. The treadmill of claim 1 wherein the control system automatically calculates the weight of the user based upon the deflection of the at least one deflection sensor.

16. The treadmill of claim 1,wherein the control system is configured to prevent the treadmill from operating until a signal received from the at least one deck deflection sensor exceeds a predetermined magnitude.

17. The treadmill of claim 16, wherein the predetermined magnitude of signal corresponds to a weight of at least 30 pounds.

18. The treadmill of claim 16,wherein the predetermined magnitude of signal corresponds to a weight of at least 40 pounds.

19. The treadmill of claim 16, wherein the predetermined magnitude of signal corresponds to a weight of at least 50 pounds.

20. The treadmill of claim 16,wherein the at least one deck deflection sensor is at least two deck deflection sensors positioned in a spaced-apart locations about the deck.

21. The treadmill of claim 16, wherein the at least one deck deflection sensor is at least four deck deflection sensors positioned in a spaced-apart locations about the deck.

22. The treadmill of claim 16, wherein the at least one deck deflection sensor is at least six deck deflection sensors positioned in a spaced-apart locations about the deck.

23. The treadmill of claim 16, wherein the deck deflection sensor is a contactless displacement sensor including an electrical intermediate device and an aerial.

24. The treadmill of claim 23, wherein the electrical intermediate device is selected from the group consisting of a passive resonant electrical circuit, a powered resonant electrical circuit, a resonant LC circuit, a conductive metal slug, and a conductive ferrite slug.

25. The treadmill of claim 23, wherein the aerial includes a transmit winding and a receive winding.

26. The treadmill of claim 23, wherein the shape of the aerial is selected from the group consisting of a substantially planar shape, a curved shape forming part of a cylinder, a hemi-spherical shape, and an arcuate shape.

27. The treadmill of claim 23, wherein the electrical intermediate device includes a resonant LC circuit, and wherein the distance separating the device and the aerial is within the range of 0.1 to 100 mm.

28. The treadmill of claim 27, wherein the separation between the electrical intermediate device and the aerial is measured along a first direction, and wherein as the electrical intermediate device moves with respect to the aerial in a second direction, different from the first direction, the accuracy of the deck deflection sensor is not significantly negatively affected by variations in the separation distance range between 0.1 to 100 mm.

29. The treadmill of claim 1, wherein the treadmill is configured to detect a user's weight and wherein the at least one deck deflection sensor is coupled to the deck such that application of a user's weight to the deck assembly produces a change in mutual inductance between the transmit and receive windings.

30. The treadmill of claim 29, wherein the at least one deck deflection sensor is at least four deck deflection sensors positioned in a spaced-apart locations about the deck.

31. The treadmill of claim 29, wherein the at least one deck deflection sensor is at least six deck deflection sensors positioned in a spaced-apart locations about the deck.

32. The treadmill of claim 29, wherein the at least one deck deflection sensor further includes an electrical intermediate device selected from the group consisting of: a passive resonant electrical circuit, an active resonant electrical circuit, a resonant LC circuit, a conductive metal slug, and a conductive ferrite slug.

33. The treadmill of claim 29, wherein the transmit and receive windings of the deck deflection sensor are formed into an aerial, and wherein the shape of the aerial is selected from the group consisting of a substantially planar shape and a curved shape forming part of a cylinder.

34. The treadmill of claim 29, wherein the electrical intermediate device includes a passive resonant electrical circuit, and wherein the distance separating the device and the aerial is within the range of 0.1 to 100 mm.

35. The treadmill of claim 34, wherein the separation between the electrical intermediate device and the aerial is measured along a first direction, and wherein as the electrical intermediate device moves with respect to the aerial in a second direction, different from the first direction, the accuracy of the deck deflection sensor is not significantly negatively affected by variations in the separation distance range between 0.1 to 100 mm.

36. The treadmill of claim 29, wherein control system is configured to automatically shutdown the treadmill if the deck displacement measurement produced by the deck deflection sensor drops below a first predetermined value for a predetermined amount of time.

37. The treadmill of claim 36, wherein the first predetermined value corresponds to a non-zero weight of less than 70 pounds.

38. The treadmill of claim 36, wherein the first predetermined value corresponds to a non-zero weight of less than 50 pounds.

39. The treadmill of claim 36, wherein the predetermined amount of time is less than or equal to five seconds.

40. The treadmill of claim 29, wherein control system is configured to prevent the treadmill from operating until the deck displacement measurement produced by the deck deflection sensor exceeds a second predetermined value.

41. The treadmill of claim one and 1, wherein the second predetermined value correlates a weight of at least 30 pounds.

42. The treadmill of claim 40, wherein the second predetermined value correlates a weight of at least 50 pounds.

43. The treadmill of claim 29, wherein the transmit and receive windings are formed onto a printed circuit board.

44. The treadmill of claim 43, wherein the transmit windings include a pair of electrically separate circuits formed in an arrangement selected from the group consisting of a generally sinusoidal and generally cosinusoidal arrangement, an intersecting arrangement, and combinations thereof.

45. The treadmill of claim 44, wherein the receive windings form a generally closed loop about the transmit windings, and wherein the shape of the loop is selected from the group consisting of rectangular, oval, circular, polygonal, and irregular.

46. The treadmill of claim 1, wherein the control system is configured to supply an alternating electrical signal to the transmit windings; and wherein the treadmill further includes first and second electrical intermediate devices secured to the right and left legs of the user, respectively, each intermediate device configured to produce a variation in the mutual inductance existing between the transmit and receive windings in response to a change in the relative position of the intermediate device to the windings.

47. The treadmill of claim 46, wherein the at least one aerial is mounted directly to the deck.

48. The treadmill of claim 46, wherein the at least one aerial is positioned within the deck.

49. The treadmill of claim 46, wherein each of the first and second electrical intermediate devices are secured to the user at a location selected from the group consisting of the user's shoe, the user's ankle, the user's lower leg and the user's ankle.

50. The treadmill of claim 46, wherein the at least one aerial is at least four aerials positioned in spaced-apart locations about the deck

51. The treadmill of claim 46, wherein the first and second electrical intermediate devices are selected from the group consisting of: a passive resonant electrical circuit, a powered resonant electrical circuit, a resonant LC circuit, a conductive metal slug, and a conductive ferrite slug.

52. The treadmill of claim 46, wherein the control system is configured to determine the impact locations of the user's legs on the deck based upon the variation in the mutual inductance existing between the transmit and receive windings in response to a change in the relative position of the intermediate device to the windings.

53. The treadmill of claim 52, further comprising a lift assembly and a drive assembly wherein each of the lift assembly and the drive assembly are operably coupled to the control system.

54. The treadmill of claim 53, wherein the control system is configured to cause a variation in the speed of the treadmill based upon the position of the user on the treadmill.

55. The treadmill of claim 53, wherein the control system is configured to cause a variation in the incline of the treadmill based upon the position of the user on the treadmill.

56. The treadmill of claim 52, wherein the control system is configured to produce at least one audible warning signal based upon the position of the user on the treadmill.

57. The treadmill of claim 46, wherein the transmit windings include a pair of electrically separate circuits formed in an arrangement selected from the group consisting of a generally sinusoidal and generally cosinusoidal arrangement, an intersecting arrangement, and combinations thereof.

58. The treadmill of claim 1, further comprising:

a drive assembly coupled to one of the first and second rollers, the drive assembly including a plurality of components configured to rotate about a common axis during use;

at least one aerial coupled to the frame and positioned adjacent to at least one of the components of the drive assembly, the aerial including a second non-cylindrical arrangement of transmit and receive windings, wherein the control system is configured to produce a variation in the mutual inductance of the transmit and receive windings during use as the components moves relative to the at least one aerial, the variation in mutual induction produced by the relative movement of the component to the at least one aerial correlating to the speed of the treadmill.

59. The treadmill of claim 58, wherein the components of the drive assembly are selected from the group consisting of a rotor, an output shaft, a flywheel, and combinations thereof.

60. The treadmill of claim 59, wherein the flywheel includes at least one outwardly projection constellation, and wherein the at least one constellation is an electrical intermediate device configured to produce the variation in mutual inductance of the arrangement of transmit and receive windings.

61. The treadmill of claim 58, wherein the shape of the non-cylindrical arrangement of transmit and receive windings is selected from the group consisting of a substantially planar shape, a curved shape forming part of a cylinder, a hemi-spherical shape and an arcuate shape.

62. The treadmill of claim 1, wherein the deck assembly has a forward end and at least first and second rollers, wherein the treadmill further includes a lift assembly coupled to the frame, the lift assembly comprising:

an incline actuator and an actuating arm, the actuating arm coupled to the forward end of the deck assembly;

at least one aerial positioned proximate the forward end of the deck, the aerial including second transmit and receive windings, wherein the control system is configured to supply an alternating electrical signal to the second transmit and receive windings; and a second electrical intermediate device coupled to the forward end of the deck, the intermediate device configured to produce a variation in mutual inductance existing between the transmit and receive windings in response to a change in the relative position of the intermediate device to the windings.

63. The treadmill of claim 62, wherein the second electrical intermediate device is selected from the group consisting of: a passive resonant electrical circuit, a powered resonant electrical circuit, a resonant LC circuit, a conductive metal slug, and a conductive ferrite slug.

64. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings; and a control system operably coupled to the at least one deck deflection sensor, wherein control system is configured to automatically shutdown the treadmill if the signal produced by the deck deflection sensor drops below a predetermined value for a predetermined amount of time and wherein the predetermined value of the signal produced by the deck deflection sensor corresponds to a non-zero weight of less than 70 pounds.

65. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings; and a control system operably coupled to the at least one deck deflection sensor, wherein at least one deck deflection sensor is a plurality of spaced apart deck deflection sensors, wherein each deck deflection sensor produces a signal representative of the deflection of a separate region of the deck and, and wherein the control system is configured to process the signals from the deck sensors and to differentiate between the deck sensors, wherein the control system is configured to determine specific operating characteristics of a user of the treadmill based upon the signals from the deck deflection sensors from the separate regions of the deck and, wherein the operating characteristics are selected from the group consisting of stride length, user's speed, user's deck impact pattern, stride diagnostics, user's lateral position, user's longitudinal position and combinations thereof.

66. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings; and a control system operably coupled to the at least one deck deflection sensor, wherein the control system is configured to prevent the treadmill from operating until a signal received from the at least one deck deflection sensor exceeds a predetermined magnitude.

67. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings; and a control system operably coupled to the at least one deck deflection sensor, wherein the control system is configured to supply an alternating electrical signal to the transmit windings; and wherein the treadmill further includes first and second electrical intermediate devices secured to the right and left legs of the user, respectively, each intermediate device configured to produce a variation in the mutual inductance existing between the transmit and receive windings in response to a change in the relative position of the intermediate device to the windings.

68. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings; and a control system operably coupled to the at least one deck deflection sensor;

a drive assembly coupled to one of the first and second rollers, the drive assembly including a plurality of components configured to rotate about a common axis during use; and at least one aerial coupled to the frame and positioned adjacent to at least one of the components of the drive assembly, the aerial including a second non-cylindrical arrangement of transmit and receive windings, wherein the control system is configured to produce a variation in the mutual inductance of the transmit and receive windings during use as the components moves relative to the at least one aerial, the variation in mutual induction produced by the relative movement of the component to the at least one aerial correlating to the speed of the treadmill.

69. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including an electrical intermediate device and a non-cylindrical arrangement of transmit and receive windings; and a control system operably coupled to the at least one deck deflection sensor, wherein the deck assembly has a forward end and at least first and second rollers,; wherein the treadmill further includes a lift assembly coupled to the frame, the lift assembly comprising: an incline actuator and an actuating arm, the actuating arm coupled to the forward end of the deck assembly;

at least one aerial positioned proximate the forward end of the deck, the aerial including second transmit and receive windings, wherein the control system is configured to supply an alternating electrical signal to the second transmit and receive windings; and a second electrical intermediate device coupled to the forward end of the deck, the intermediate device configured to produce a variation in mutual inductance existing between the transmit and receive windings in response to a change in the relative position of the intermediate device to the windings.

70. A treadmill, comprising:

a frame;

a deck assembly supported by the frame, the deck assembly including a longitudinally extending deck, at least first and second rollers, and a belt positioned about the deck and the first and second rollers;

at least one deck deflection sensor coupled to the deck, the deck deflection sensor being a contactless displacement sensor including a set of transmit winding and a set of receive windings, the transmit winding configured to move independently of the receive windings upon deflection of the deck assembly, wherein the at least one deck deflection sensor is at least four deck deflection sensors positioned in spaced-apart locations about the deck; and a control system operably coupled to the at least one deck deflection sensor.

71. The treadmill of claim 70, wherein at least one of the transmit winding and the receive windings are planar.

72. The treadmill of claim 70, wherein control system is configured to automatically shutdown the treadmill if the signal produced by the deck deflection sensor drops below a predetermined value for a predetermined amount of time.

73. The treadmill of claim 72, wherein the predetermined value of the signal produced by the deck deflection sensor corresponds to a non-zero weight of less than 70 pounds.

74. The treadmill of claim 72, wherein the predetermined value of the signal produced by the deck deflection sensor corresponds to a non-zero weight of less than 60 pounds.

75. The treadmill of claim 72, wherein the predetermined value of the signal produced by the deck deflection sensor corresponds to a non-zero weight of less than 50 pounds.

76. The treadmill of claim 72, wherein the predetermined amount of time is less than or equal to five seconds.

* * * * *